United States Patent [19]

Moran, Victor A.

[11] Patent Number: 4,785,537

[45] Date of Patent: Nov. 22, 1988

[54] WOOL SHEARS

[75] Inventor: Moran, Victor A., East Ryde, Australia

[73] Assignee: Sunbeam Corporation Limited, New South Wales, Australia

[21] Appl. No.: 942,500

[22] Filed: Dec. 16, 1986

[30] Foreign Application Priority Data

Dec. 18, 1985 [AU] Australia ..... PH3929

[51] Int. Cl.[4] ..... B26B 19/00

[52] U.S. Cl. ..... 30/219; 30/221

[58] Field of Search ..... 30/215, 216, 217, 218, 30/219, 220, 221, 222

[56] References Cited

U.S. PATENT DOCUMENTS

| | | | |
|---|---|---|---|
| 576,902 | 2/1897 | Scouler | 30/219 X |
| 926,130 | 6/1909 | McQuoid | 30/219 X |
| 2,042,295 | 5/1936 | Bristow | 30/221 |
| 2,296,236 | 9/1942 | Musolf | 30/221 |
| 4,291,462 | 9/1981 | Corder | 30/221 |

FOREIGN PATENT DOCUMENTS

| | | |
|---|---|---|
| 7900 | 11/1907 | Australia . |
| 12099 | 3/1928 | Australia . |
| 551623 | 5/1986 | Australia . |

*Primary Examiner*—E. R. Kazenske
*Assistant Examiner*—Michael D. Folkerts
*Attorney, Agent, or Firm*—Ladas & Parry

[57] ABSTRACT

A wool shearing handpiece enclosed within a casing through which extends a drive fork driven at a rear end for oscillation about an intermediate pivot to reciprocate at an open forward end of the casing a cutter across a comb, and wherein the closing force between the cutter and the comb is derived from a frame having a pair of depending arms which at least partly span and bear down upon a forward end portion of the fork with an adjustable force.

8 Claims, 4 Drawing Sheets

WOOL SHEARS

This invention relates to handpieces used in the wool shearing industry.

BACKGROUND ART

According to contemporary forms of shearing handpieces crank drive to a cutter reciprocating over a fixed comb is derived through a fork supported upon a medial pivot and to a rear end of which drive is applied. The cutter is secured by so-called "chicken's feet" to the forward end of the fork and closing pressure between the cutter and the comb is determined by an adjustable thrust pin (traditionally called a "tension pin") bearing upon the fork's forward end. Such an arrangement is disclosed in Australian Patent Specifications Nos. 7900/07 and 12099/28. However, it is known that uneven wear between the cutter and the comb arises due to a twisting force imposed upon the fork as the cutter reciprocates towards at least one of its extreme lateral positions with respect to the comb. Inefficient shearing also results.

Attempts to overcome this problem have been made, one of which is disclosed in Australian Patent Specification No. 551 623, where an abutment is provided to engage an intermediate portion of the thrust pin to impart bending movement thereto to restrain rocking motion of the crank drive. A further proposal is disclosed in U.S. Pat. Specification No. 4 291 462 where the conventional thrust pin is replaced by a bent tensioning arm which is pivotally mounted with one end bearing upon the fork and its other end extending on an axis colinear with the pivotal axis of the fork. These proposals have only met with limited success mainly due to the rigorous task to which these appliances are applied. The invention of U.S. patent application Serial No. 809 503, having a common assignee with the instant application, is a recent proposal for improvement.

DISCLOSURE OF THE INVENTION

It is the object of the invention to provide an effective solution to the problem which is simple and inexpensive To this end, according to the invention, there is provided a shearing handpiece comprising an elongated casing, a drive fork extending throughout the casing, a comb supported upon a forward end of the casing, means for a rear end portion of the drive fork to receive driving power, a cutter held against the comb by a forward end portion of the drive fork, an intermediate pivot for the fork and supported by the casing, and an adjustable movable frame having two overhead arms bearing downwardly upon the forward end portion of the fork to impose a closing force between the cutter and the comb.

BRIEF DESCRIPTION OF DRAWINGS

The invention will be better understood from a reading of the following description in conjunction with the accompanying drawings, in which.

BEST MODE OF CARRYING OUT THE INVENTION

Figure 1:
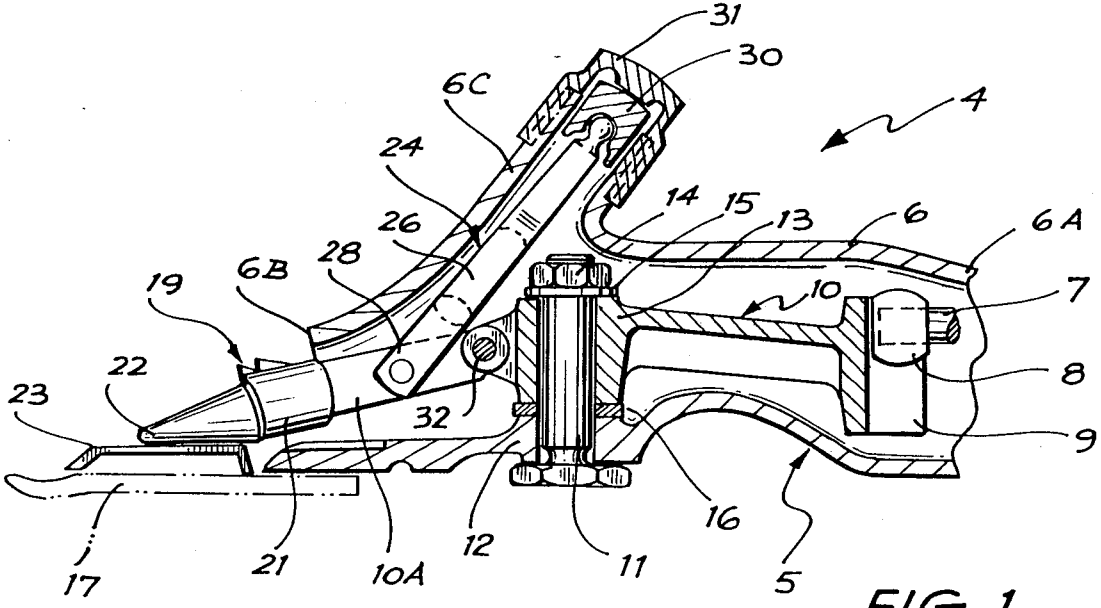
FIG. 1 shows in longitudinal cross-section the front section of a shearing handpiece constructed in accordance with one embodiment of the invention.
Figure 2:
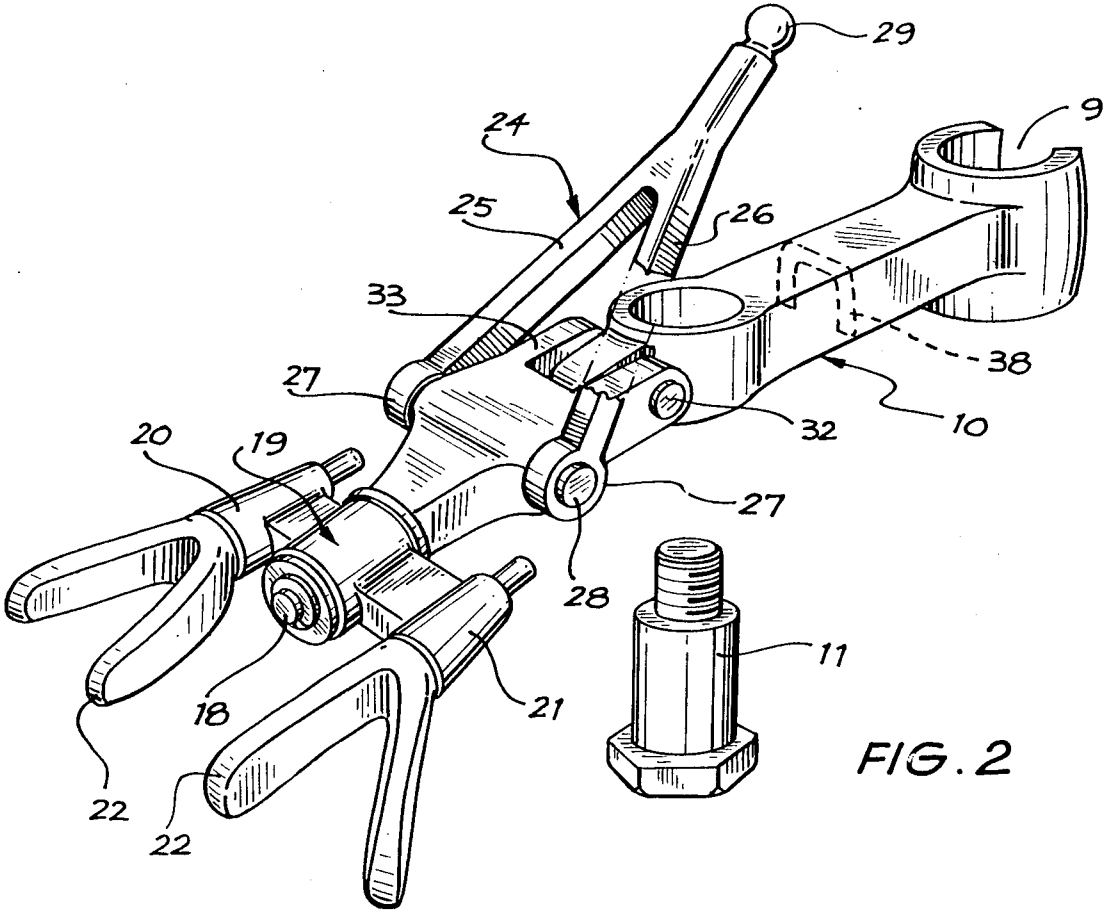
FIG. 2 is a perspective of the fork incorporated in the handpiece of FIG. 1.

The embodiment shown in FIGS. 1 and 2 consists of a handpiece 4, of which only the forward end section 5 is depicted, having an outer metal casing 6 with a rearward end 6A and a forward end 6B. The driving crank 7 and rotatable ball 8 from the rear driving section (not shown) of the handpiece 4 engages within a driven socket 9 at the rear end of a drive fork 10. A fulcrum pin 11 passing through a boss 12 in the underside of the casing 6 serves as an intermediate journal for the drive fork 10. The pin 11 penetrates a boss 13 integral with the fork 10 and is secured by a nut 14 at the distal side of the fork 10. Flat washers 15 and 16 are provided to reduce friction between the boss 13 and the nut 14 and casing 6 as the fork oscillates about the fulcrum pin 11 in response to force applied by the drive crank 7.

A comb 17 is fixed to the forward end 6B of the casing 6 at its underside with the forward end 6B open to allow the fork 10 to protrude therethrough. The forward protruding end 1OA of the fork 10 terminates in a spigot 18 upon which is rotatably mounted a carrier 19 provided with two lateral sockets 20 and 21 which rotatably mount chicken's feet 22 which in turn hold the cutter 23 against the comb 17. Therefore, as the fork 10 reciprocates under the action of the crank pin 7 the cutter 23 is caused to oscillate across the comb 17.

It is necessary to provide the operator with a facility for adjustment of the closing force between the cutter 23 and the comb 17. In this embodiment the facility is provided by a frame 24, of inverted Y-shape with the end of the arms 25 and 26 formed as cylindrical enlargements 27 journalled upon posts 28 laterally and integrally formed upon the forward end portion 10A of the fork 10. A ball 29 provided at the opposite end of the frame 24 is accommodated within a socket 30 forced against the ball 29 by thimble, or cap, 31 threadably engaged with an upper extension 6C of the casing 6. Furthermore, the forward end 10A of the fork 10 is articulated with respect to the rearward end by a hinge pin 32 penetrating a clevis 33 on the fork forward end 10A.

From an appreciation of the above-described construction it will apparent that should the thimble 31 be screwed down onto the extension 6C of the casing 6 force will be applied through the frame 24 to rotate the forward end 10A of the fork 10 about the hinge pin 32 to urge the cutter 23 onto the comb 17, to increase the closing force therebetween. As the fork 10 reciprocates about its fulcrum pin 11 the frame 24 will move to and fro through universal movement provided between the ball 29 and its socket 30 while the frame 24 will restrain torque forces acting upon the fork 10.

Figure 3:
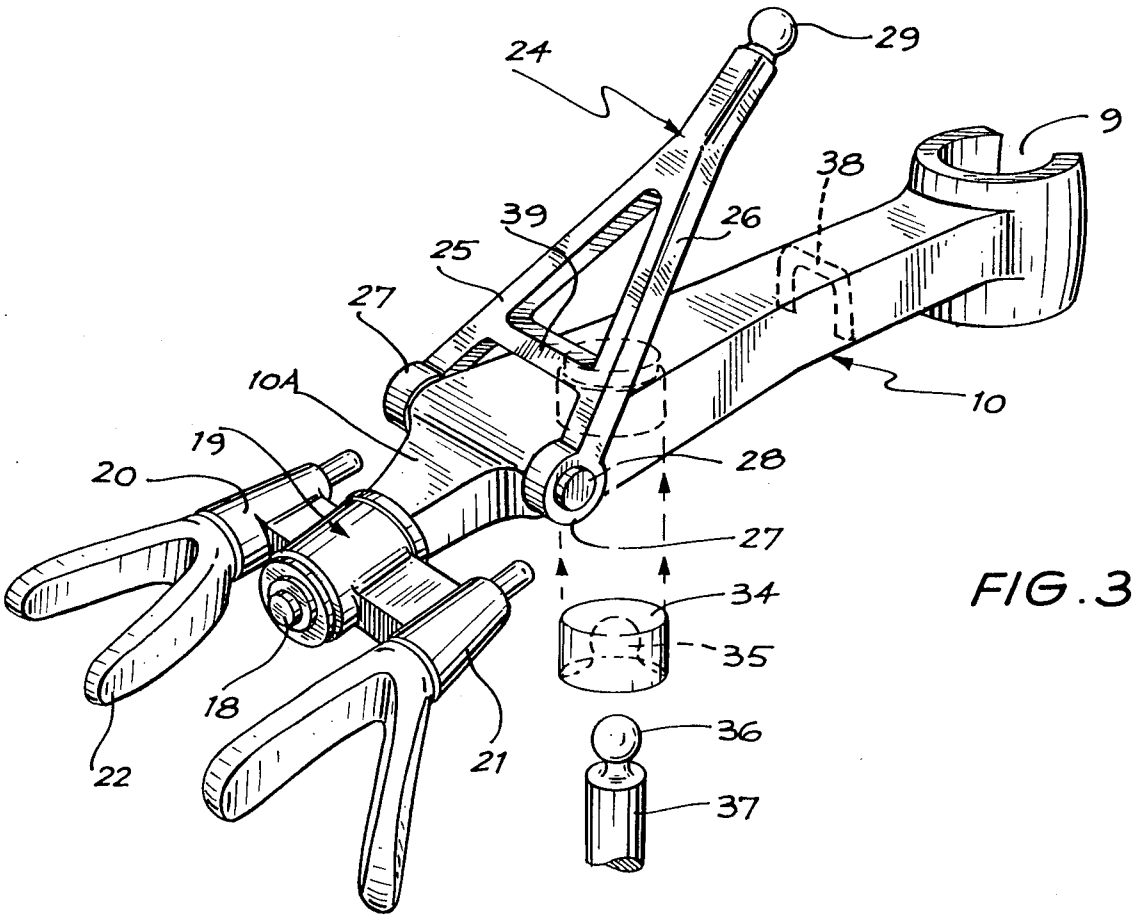
FIG. 3 is a perspective of another form of the fork.

According to the alternative embodiment shown in FIG. 3, the fork 10 is of unitary construction and its reciprocation is facilitated by the insertion therein of a hardened steel socket 34 the cavity 35 of which accommodates a fulcrum ball 36 fixed, or integrally formed, upon a support post 37 upstanding from the bottom part of the casing 6. Therefore, with increasing closing tension applied to the cutter, the fork 10 tilts forwardly about the ball 36. As shown in both this and the former embodiment the fork 10 may be composed of inverted channel section as shown by the outline 38. A strut 39 may interconnect the arms 25 and 26 of the frame 24 as shown in FIG. 3, for reinforcement.

Figure 4:
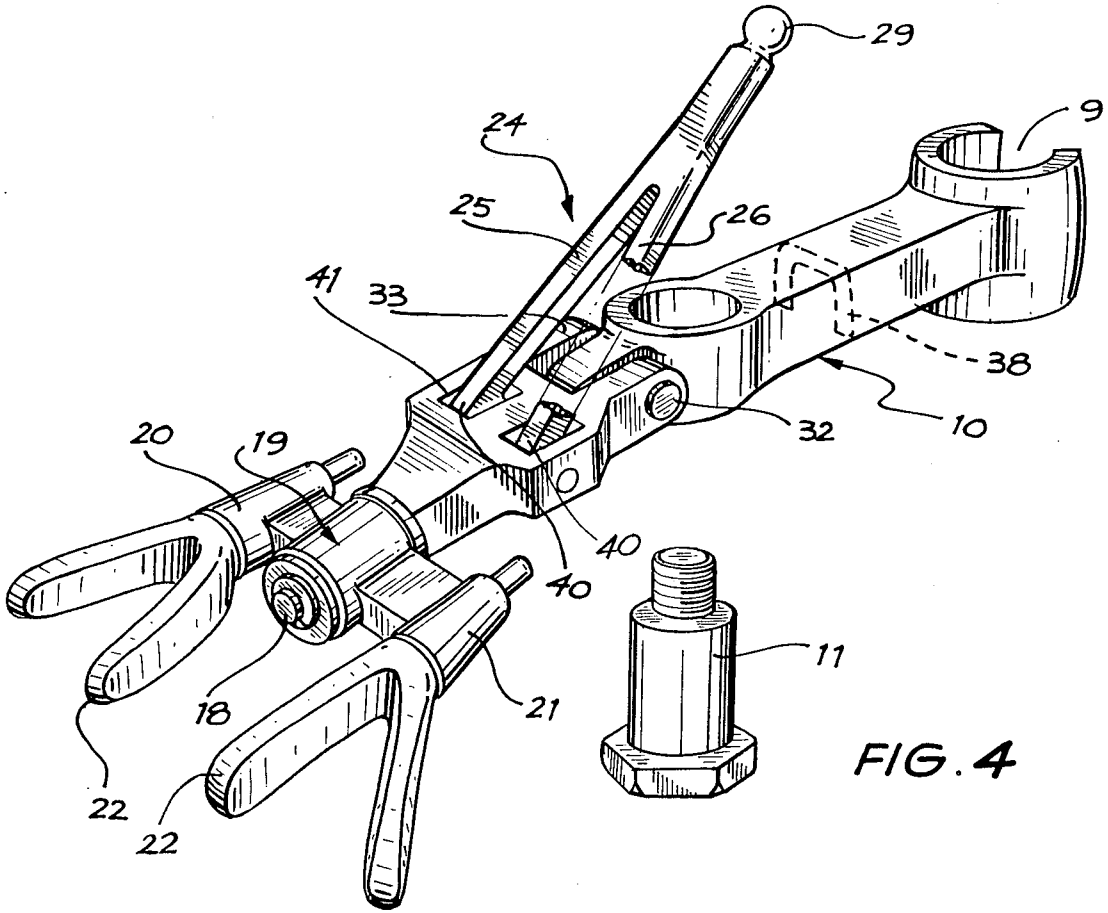
FIG. 4 is a fragmentary view of the fork showing a modification.

It is conceivable, also, that a different form of engagement between the frame 24 and the fork 10 may be employed and this is illustrated in FIG. 4 which represents a modification of the embodiment of FIG. 2. In this instance the end of each of the arms 25 and 26 may be formed with a hardened rounded end, or ball, 40 engaged in a respective one of transverse guide slots 41 formed in the upper part of the forward end 10A of the fork 10 with the frame 24 restrained from lateral movement. Hence, as the forward end 1OA of the fork 10 reciprocates the balls, or ends, 40 on the arms 25 and 26 will slide along their respective slots 41. The bottom of these slots preferably are towards their outer ends upwardly inclined out of the plane of the fork 10 to maintain uniform closing force between the cutter 23 and its comb 17 during the whole of its reciprocation. The same modification may, of course, be applied to the embodiment of FIG. 3.

Whereas several embodiments have been disclosed in the foregoing passages it should be understood that other forms, modifications and refinements are possible within the scope of this invention.

What I claim is:

1. A shearing handpiece comprising an elongated casing, a drive fork extending throughout the casing, a comb supported upon a forward end of the casing, means for a rear end portion of the drive fork to receive driving power, a cutter held against the comb by a forward end portion of the drive fork, said drive fork causing said cutter to reciprocate across the face of said comb, an intermediate pivot for the fork supported by the casing, an upwardly extending hollow extension on said casing, a frame of inverted Y-shape having an upwardly extending support leg and a pair of downwardly diverging arms at least partly spanning and bearing downwardly upon the forward end portion of the fork and integrally depending from said support leg such that said support leg and said arms form a rigid inflexible member, said support leg extending upwardly into said hollow extension, and adjustment means threadedly engaged on an upper end of said hollow extension and abutting the upper end of said support leg to impose a closing force between the cutter and the comb through said Y-shaped frame.

2. A shearing handpiece as claimed in claim 1, wherein the forward and rearward end portions of said drive fork are articulated, and said intermediate pivot is a fulcrum pin penetrating and providing a journal for the rearward end portion of the drive fork.

3. A shearing handpiece as claimed in claim 1 or 2, wherein said forward end portion of the fork carries laterally projecting posts, and the arms of said frame are pivotally fixed to said posts to opposite sides of the fork.

4. A shearing handpiece as claimed in claim 1, wherein the arms of said frame have their ends engaged within respective guide slots extending transversely across the forward end portion of the fork, to permit relative movement between said arms and said fork.

5. A shearing handpiece as claimed in claim 1, wherein said intermediate pivot includes a fulcrum ball supported by the casing and engaging within a socket in the underside of the fork.

6. A shearing handpiece as claimed in claim 5, wherein said fork is of unitary construction.

7. A shearing handpiece as claimed in claim 5 or 6, wherein said forward end portion of the fork carries laterally projecting posts, and the arms of said frame are pivotally fixed to said posts to opposite sides of the fork.

8. A shearing handpiece as claimed in claim 5 or 6, wherein the arms of said frame have their ends engaged within respective guide slots extending transversely across the forward end portion of the fork, to permit relative movement between said arms and said fork.

* * * * *